US011179954B2

(12) United States Patent
Fukasawa

(10) Patent No.: US 11,179,954 B2
(45) Date of Patent: Nov. 23, 2021

(54) PRINTER

(71) Applicant: SEIKO EPSON CORPORATION, Tokyo (JP)

(72) Inventor: Koki Fukasawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 58 days.

(21) Appl. No.: 16/830,165

(22) Filed: Mar. 25, 2020

(65) Prior Publication Data

US 2020/0307287 A1 Oct. 1, 2020

(30) Foreign Application Priority Data

Mar. 28, 2019 (JP) ..... JP2019-062578

(51) Int. Cl.
*B41J 29/13* (2006.01)

(52) U.S. Cl.
CPC ..... *B41J 29/13* (2013.01)

(58) Field of Classification Search
CPC ..... B41J 29/13
See application file for complete search history.

(56) References Cited

U.S. PATENT DOCUMENTS 9,421,781 B2 * 8/2016 Kimura ..... B41J 2/20

FOREIGN PATENT DOCUMENTS

JP 2016-068510 5/2016

* cited by examiner

*Primary Examiner* — Justin Seo
(74) *Attorney, Agent, or Firm* — Workman Nydegger

(57) ABSTRACT

A printer includes a carriage in which a discharging head configured to discharge ink and an ink storage unit configured to store the ink to be supplied to the discharging head are mounted, and a lid member provided to the carriage. The lid member is rotatable to a first position and a second position, when the lid member is located at the first position, a supply port included in the ink storage unit is exposed, a first portion is located above the ink storage unit so as to limit removal of the ink storage unit from the carriage, and a lower end of a second portion is located below the supply port, and when the lid member is located at the second position, the ink storage unit is removable from the carriage, and the first portion and the second portion are located above the supply port.

4 Claims, 6 Drawing Sheets

PRINTER

The present application is based on, and claims priority from JP Application Serial Number 2019-062578, filed Mar. 28, 2019, the disclosure of which is hereby incorporated by reference herein in its entirety.

BACKGROUND

The present disclosure relates to a printer.

For example, a printer that performs printing by discharging ink from a discharging head is known as disclosed in JP-A-2016-68510. In the printer, a sub-tank as an example of an ink storage unit is mounted in a carriage that can move back and forth, and ink is supplied from the sub-tank to the discharging head.

A connection port, which is an example of a supply port, is provided in the sub-tank. The ink stored in the main tank is supplied to the sub-tank through an ink injecting unit inserted into the connection port.

SUMMARY

The ink may scatter when the ink injecting unit is inserted into the connection port and when the ink injecting unit is pulled out from the connection port. However, for example, when a wall for preventing the scattering of ink is provided to the carriage, it is difficult to clean the ink adhered to a wall and/or a portion near the connection port.

According to one embodiment, a printer includes a carriage in which a discharging head configured to discharge ink and an ink storage unit configured to store the ink to be supplied to the discharging head are mounted, the carriage being configured to move along a guide shaft, and a lid member provided to the carriage. The ink storage unit is detachable from the carriage, the lid member is rotatable to a first position and a second position. When the lid member is located at the first position, a supply port included in the ink storage unit is exposed, a first portion of the lid member is located above the ink storage unit in a vertical direction so as to limit removal of the ink storage unit from the carriage, a lower end of a second portion of the lid member is located below the supply port in the vertical direction, and when the lid member is located at the second position, the ink storage unit is removable from the carriage, and the first portion and the second portion are located above the supply port in the vertical direction.

DESCRIPTION OF EXEMPLARY EMBODIMENTS

Figure 1:
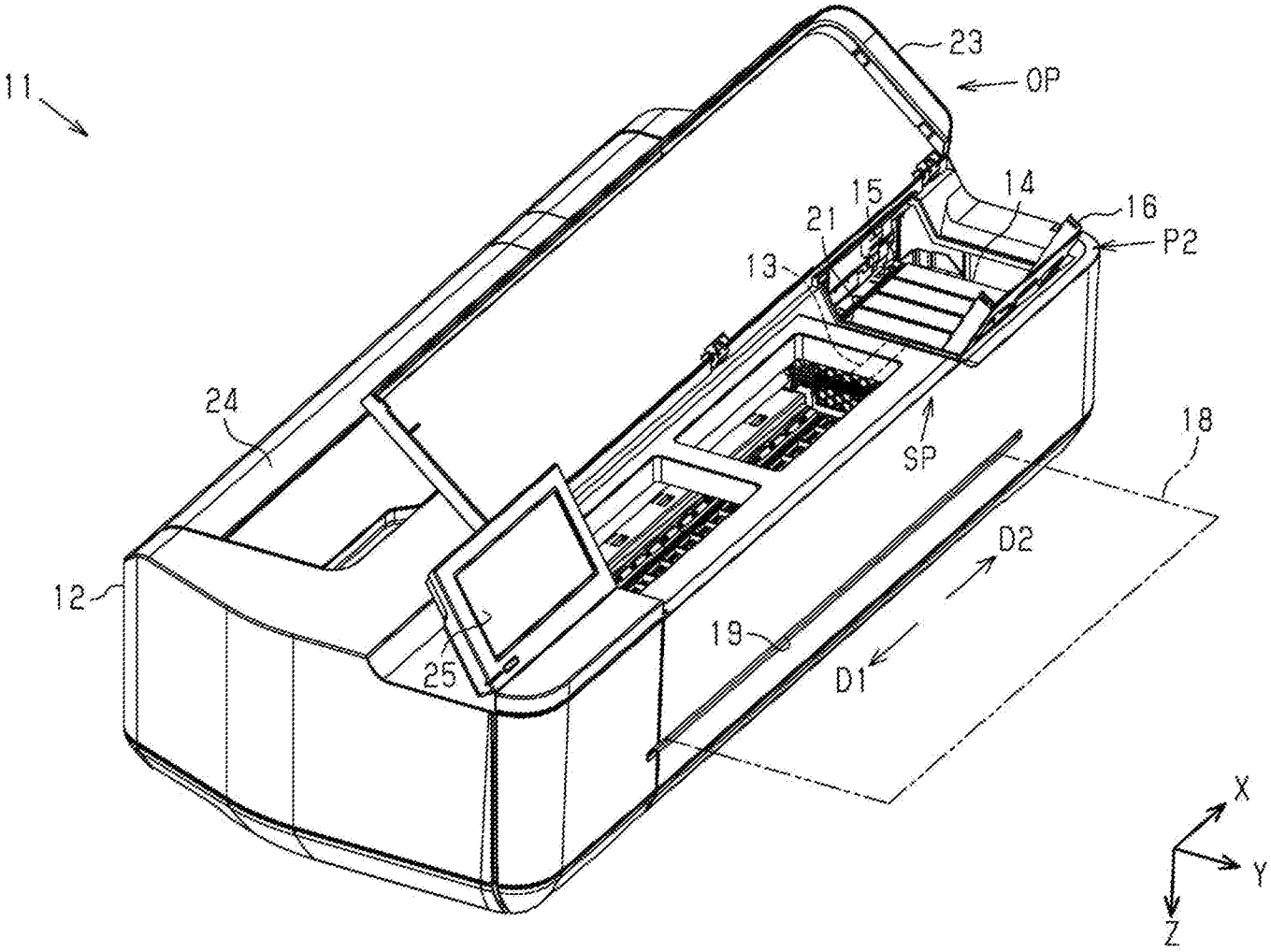
FIG. 1 is a perspective view of a printer according to an embodiment.

An embodiment of a printer will be described below with reference to the accompanying drawings. The printer is an ink-jet printer that prints characters and/or images on a medium such as a sheet by discharging ink.

In the drawings, on the assumption that a printer 11 is placed on a horizontal plane, the Z axis indicates the gravity direction and the X axis and the Y axis indicate directions along the horizontal plane. The X, Y, and Z axes are orthogonal to each other. In the following description, the direction along the X axis is also referred to as a first direction D1 and a second direction D2 opposite to the first direction D1, and the direction along the Y axis is also referred to as front and rear that is opposite to the front. The Z axis is the vertical direction, and the direction along the Z axis is also referred to as lower in the vertical direction and upper in the vertical direction opposite to the lower in the vertical direction.

As illustrated in FIG. 1, the printer 11 includes a case 12 having a rectangular shape. The printer 11 includes a carriage 15 in which a discharging head 13 that discharges ink and an ink storage unit 14 that stores ink to be supplied to the discharging head 13. The printer 11 includes a lid member 16 provided on the carriage 15. The ink storage unit 14 is detachably mounted to the carriage 15.

An outlet 19 for ejecting a printed medium 18 is formed on a front surface, which is a front side surface, of the case 12. The outlet 19 has a shape that reduces the possibility of entry of foreign matters into the case 12 from the outside while achieving ejection of the medium 18. The outlet 19 in this embodiment has a slit shape with a small length in the vertical direction.

The case 12 may have an opening 21. The opening 21 is located on the upper side in the vertical direction relative to the carriage 15 located at the ink supply position SP that allows the user to supply ink to the ink storage unit 14, and the opening 21 and the carriage 15 located at the ink supply position SP overlap each other when viewed from the upper side in the vertical direction. When the carriage 15 is located at the ink supply position SP, the lid member 16 is rotatable to a first position P1 illustrated in FIG. 2 and a second position P2 illustrated in FIG. 1.

In the state where the lid member 16 is located at the first position P1, a shaft of the lid member 16 is located at the front end of the lid member 16 and is parallel to the X axis. The lid member 16 located at the first position P1 limits the removal of the ink storage unit 14 from the carriage 15. The lid member 16 located at the second position P2 allows the removal of the ink storage unit 14 from the carriage 15.

The ink storage unit 14 mounted in the carriage 15 is removed from the carriage 15 by pulling the ink storage unit 14 to the upper side in the vertical direction in the state where the lid member 16 is located at the second position P2. The ink storage unit 14 is mounted to the carriage 15 by pushing the ink storage unit 14 to the lower side in the vertical direction from a position on the upper side of the carriage 15 in the vertical direction. The lid member 16 located at the second position P2 may interfere with the opening 21 to limit the movement of the carriage 15.

A printer cover 23, a rear cover 24 located on the rear side relative to the printer cover 23, and an operation panel 25 located on the side of the first direction D1 relative to the printer cover 23 may be provided to on a top surface, which is a surface on the upper side in the vertical direction, of the case 12. Each of the printer cover 23, the rear cover 24, and the operation panel 25 of this embodiment includes a shaft parallel to the X-axis and is rotatable about the shaft.

Figure 4:
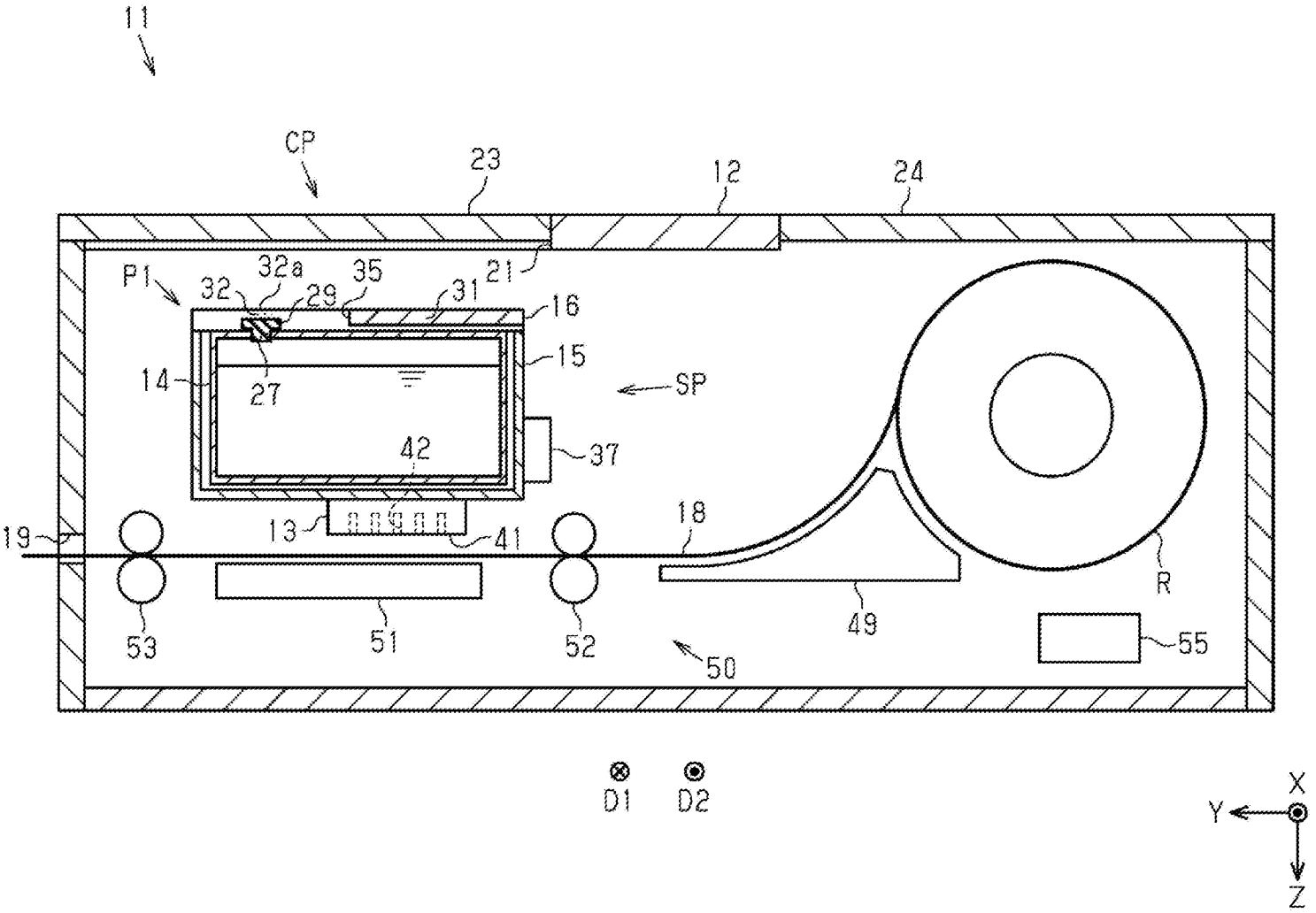
FIG. 4 is a schematic side view illustrating an internal configuration of the printer in which a lid member is located at a first position.

The printer cover 23 is rotatable to a cover position CP illustrated with a solid line in FIG. 4 and an open position OP illustrated in FIG. 1, which differs from the cover position CP. The printer cover 23 rotates about a shaft located at the rear end of the printer cover 23 in the state where the printer cover 23 is located at the cover position CP. The printer cover 23 located at the cover position CP covers the opening 21. The printer cover 23 located at the open position OP exposes the opening 21. When the printer cover 23 is located at the open position OP, ink can be provided to the ink storage unit 14 through the opening 21. In other words, the user can provide ink to ink storage unit 14 through the opening 21 when the printer cover 23 is located at the open position OP.

The rear cover 24 is rotatable to a close position illustrated in FIG. 1 and an open position, which is not illustrated. The rear cover 24 rotates about a shaft located at the rear end of the rear cover 24 in the state where the rear cover 24 is located at the close position. To the space that opens when the rear cover 24 is located at the open position, the user can load a roll body R illustrated in FIG. 4 in which the medium 18 is wound in a cylindrical shape.

The operation panel 25 rotates to an upright position illustrated in FIG. 1 and a tilted position (not illustrated) tilted to the rear side from the upright position. The shaft of the operation panel 25 is located at the front end. The operation panel 25 located at the upright position faces the front side.

Figure 2:
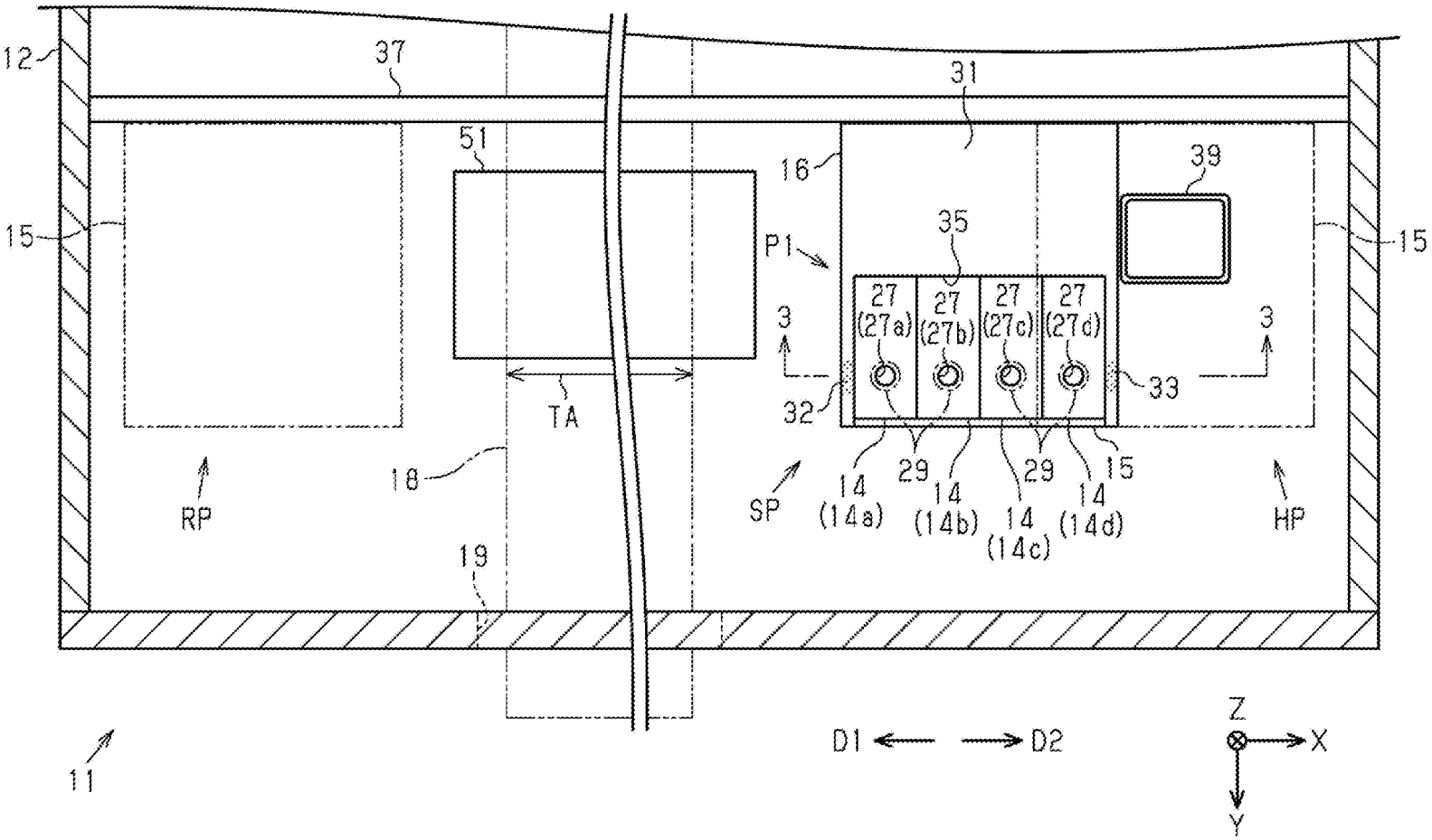
FIG. 2 is a schematic plan view illustrating an internal configuration of the printer.

As illustrated in FIG. 2, the ink storage unit 14 includes a supply port 27. The supply port 27 opens at a top surface, which is a surface on the upper side in the vertical direction, of the ink storage unit 14. The printer 11 of this embodiment is a color printer that performs printing by various types of discharging inks, in which a plurality of the ink storage units 14 storing different types of inks are mounted in the carriage 15. The carriage 15, in which the plurality of ink storage units 14 are arranged in the first direction D1, moves in the first direction D1 and the second direction D2.

Specifically, in the carriage 15, the ink storage unit mounted at the end in the first direction D1 in the plurality of ink storage units 14 is a first ink storage unit 14*a* that stores ink and black ink as an example of a first ink. The carriage 15 includes, in the order from the first ink storage unit 14*a* in the second direction D2, a second ink storage unit 14*b* that stores magenta ink, which is an example of a second ink, a third ink storage unit 14*c* that stores yellow ink, and a fourth ink storage unit 14*d* that stores cyan ink.

The first ink storage unit 14*a* includes a first supply port 27*a*, which is an example of a supply port. The second ink storage unit 14*b* includes a second supply port 27*b*. The third ink storage unit 14*c* includes a third supply port 27*c*. The fourth ink storage unit 14*d* includes a fourth supply port 27*d*. The first supply port 27*a* to the fourth supply port 27*d* are located at the same position in the vertical direction and are arranged in the first direction D1.

The first ink storage unit 14*a* to fourth ink storage unit 14*d* store different types of inks, but have the same configuration. Therefore, in the following description, one ink storage unit 14 of the first ink storage unit 14*a* to the fourth ink storage unit 14*d* is described.

The ink storage unit 14 may include a plug 29 that plugs the supply port 27. The plug 29 is detachably provided to the supply port 27. The plug 29 may be coupled to any one of the ink storage unit 14, the lid member 16, and the carriage 15.

The lid member 16 includes a first portion 31 and a second portion 32. The lid member 16 may include a third portion 33. The first portion 31 is an upper wall that is located on the upper side of the ink storage unit 14 in the vertical direction when the lid member 16 is located at the first position P1. The second portion 32 and the third portion 33 are portions that are arranged in the first direction D1 with the supply port 27 in the side walls arranged in the horizontal direction with the ink storage unit 14 when the lid member 16 is located at the first position P1. In the drawings, the second portion 32 and the third portion 33 are illustrated with hatching.

The first portion 31 of the lid member 16 located at the first position P1 is located on the upper side of the ink storage unit 14 in the vertical direction. Thus, the first portion 31 and the ink storage unit 14 overlap each other when viewed from the upper side in the vertical direction, and the first portion 31 limits the movement of the ink storage unit 14 in the vertical direction.

The lid member 16 includes a cut portion 35 cut from the front end to a position on the rear side relative to the supply port 27 in the state located at the first position P1. The first portion 31 located on the rear side of the cut portion 35 is located on the rear side relative to the supply port 27. Thus, the lid member 16 located at the first position P1 exposes, to the upper side in the vertical direction, the supply port 27 for supplying ink to the ink storage unit 14.

Figure 3:
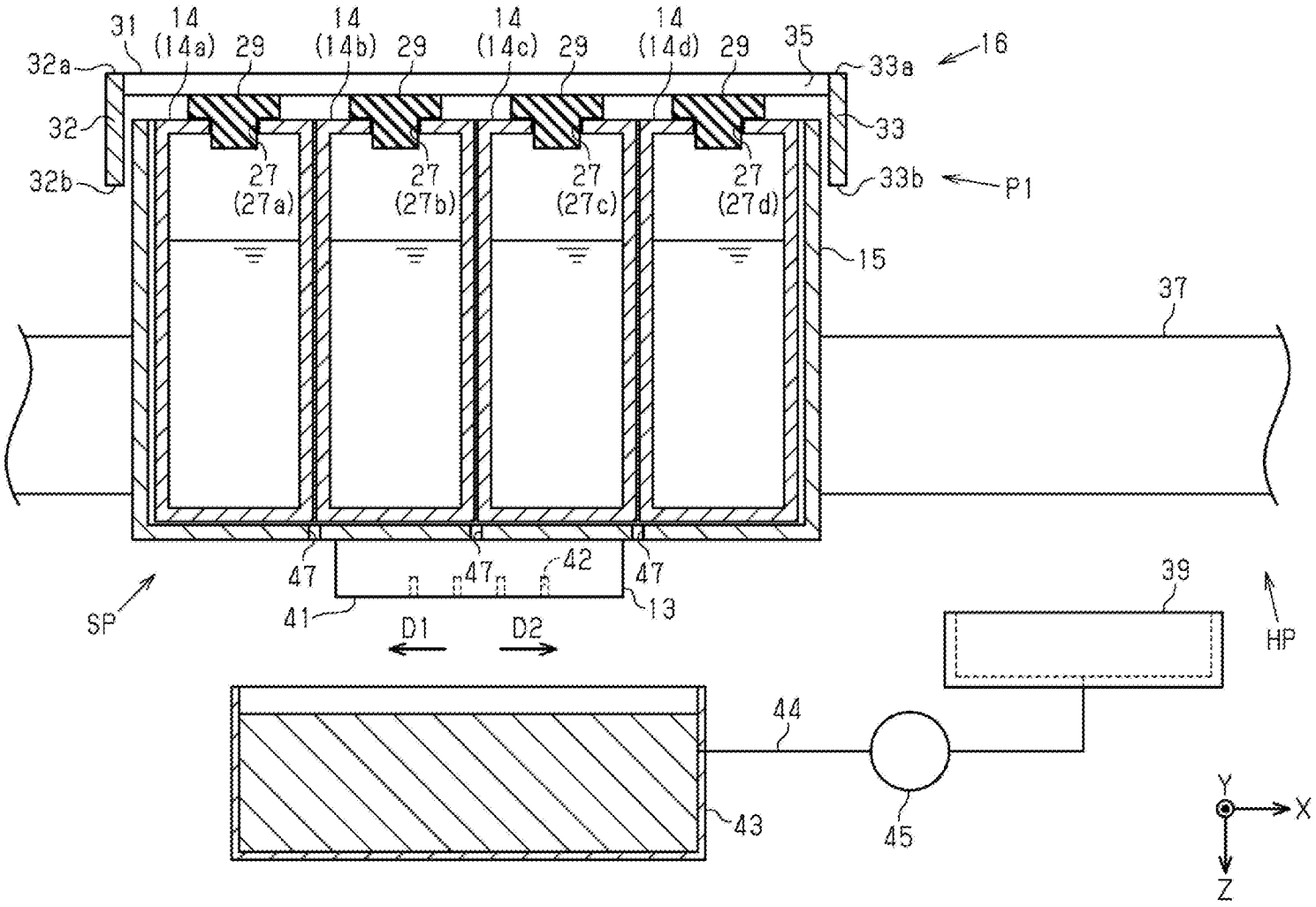
FIG. 3 is a schematic cross-sectional view taken in a direction of an arrow of a line 3-3 of FIG. 2.

As illustrated in FIG. 3, in the lid member 16 located at the first position P1, an upper end 32*a* of the second portion 32 is located on the upper side relative to the first supply port 27*a* to the fourth supply port 27*d* in the vertical direction, and a lower end 32*b* of the second portion 32 is located on the lower side relative to the first supply port 27*a* to the fourth supply port 27*d* in the vertical direction. In the lid member 16 located at the first position P1, an upper end 33*a* of the third portion 33 is located on the upper side relative to the first supply port 27*a* to the fourth supply port 27*d* in the vertical direction, and a lower end 33*b* of the third portion 33 is located on the lower side relative to the first supply port 27*a* to the fourth supply port 27*d* in the vertical direction.

The second portion 32 and the third portion 33 sandwich the first supply port 27*a* to the fourth supply port 27*d* in the first direction D1 in which the first supply port 27*a* to the fourth supply port 27*d* are arranged. As such, when viewed in the first direction D1, the first supply port 27*a* to the fourth supply port 27*d* are hidden by the second portion 32 of the lid member 16 located at the first position P1. When viewed in the second direction D2, the first supply port 27*a* to the fourth supply port 27*d* are hidden by the third portion 33 of the lid member 16 located at the first position P1.

As illustrated in FIGS. 2 and 3, the printer 11 includes a guide shaft 37 that supports the carriage 15. The carriage 15 moves along the guide shaft 37 to a home position HP and a returning position RP, which is located on the side of the first direction D1 relative to the home position HP. The carriage 15 is provided so as to be movable back and forth between the home position HP and the returning position RP. A transport region TA in which the medium 18 to which the ink is discharged is transported, and an ink supply position SP are provided between the home position HP and the returning position RP in the first direction D1. The transport region TA is a region through which the medium 18 of a maximum size printable by the printer 11 passes. The ink supply position SP is located between the transport region TA and the home position HP in the first direction D1.

The printer 11 includes a cap 39 disposed on the lower side of the home position HP in the vertical direction. The cap 39 caps the discharging head 13 when the carriage 15 is located at the home position HP.

When the lid member 16 is located at the first position P1, the second portion 32 is located on the side of the first direction D1 relative to the first ink storage unit 14*a* to the fourth ink storage unit 14*d*. When the carriage 15 is located at the ink supply position SP and the lid member 16 is located at the first position P1, the second portion 32 is located between the transport region TA and the supply port 27 in the first direction D1 in which the carriage 15 moves.

When the lid member 16 is located at the first position P1, the third portion 33 is located on the side of the second direction D2 relative to the first ink storage unit 14*a* to the fourth ink storage unit 14*d*. When the carriage 15 is located at the ink supply position SP and the lid member 16 is located at the first position P1, the third portion 33 is located between the cap 39 and the supply port 27 in the first direction D1 in which the carriage 15 moves.

As illustrated in FIG. 3, the discharging head 13 includes a plurality of nozzles 42 that open at the nozzle surface 41. The printer 11 may include a waste liquid tank 43 that houses waste liquid, a tube 44 that connects the cap 39 and the waste liquid tank 43, and a suction pump 45 that reduces the inner pressure of the cap 39 through the tube 44. In the case of suction cleaning of the discharging head 13 is performed, the suction pump 45 is driven in the state where the cap 39 is in contact with the discharging head 13, and negative pressure is exerted on the nozzle 42. In the suction cleaning, thickened ink and/or air bubbles in the discharging head 13 can be ejected. The ink ejected from the nozzle 42 is housed in the waste liquid tank 43 as waste liquid.

The carriage 15 may include an ink passage 47. The carriage 15 may include a plurality of the ink passages 47. The ink passage 47 is located on the lower side relative to the supply port 27 in the vertical direction, and ejects, to the outside of the carriage 15, the ink that has been leaked from the ink storage unit 14 without being supplied to the ink storage unit 14. The printer 11 may have a configuration in which the waste liquid tank 43 is provided on the lower side of the ink supply position SP in the vertical direction, and the ink ejected through the ink passage 47 is housed in the waste liquid tank 43.

As illustrated in FIG. 4, the printer 11 includes a guide member 49 that guides the medium 18 fed from the roll body R, a transport unit 50 that transports the medium 18 in the transport region TA, and a support 51 that supports the medium 18 transported by the transport unit 50. The transport unit 50 transports, downstream in the transport direction, the medium 18 fed from the roll body R. Note that, in this embodiment, the transport direction is a direction in which the medium 18 is transported along the members of the printer 11, such as the guide member 49 and the support 51. The transport unit 50 includes a transport roller pair 52 provided between the guide member 49 and the support 51 in the transport direction, and an ejection roller pair 53 provided between the support 51 and the outlet 19 in the transport direction. The transport roller pair 52 and the ejection roller pair 53 rotate with the medium 18 sandwiched therebetween to transport the medium 18.

The transport unit 50 transports, downstream in the transport direction, the medium 18 fed from the roll body R and ejects the medium 18 in the ejection direction from the outlet 19. The outlet 19 is located on the front side relative to a printing position where the discharging head 13 that moves with the carriage 15 performs printing on the medium 18. The transport unit 50 transports, toward the front side, the medium 18 located at the printing position, and ejects the medium 18 toward the front side from the outlet 19. In other words, the transport direction and the ejection direction at the printing position coincide with the front direction.

The printer 11 includes a control unit 55 that comprehensively controls the driving of each mechanism in the printer 11. The control unit 55 is composed of, for example, a processing circuit including a memory and a computer, and the like. The control unit 55 controls various operations executed by the printer 11 in accordance with a program stored in the memory.

Next, operations of this embodiment are described.

In a standby state in which the printing is not executed, the carriage 15 is located at the home position HP.

As illustrated in FIG. 2, when ink is supplied from the supply port 27 to the ink storage unit 14, the control unit 55 moves the carriage 15 to the ink supply position SP.

Figure 5:
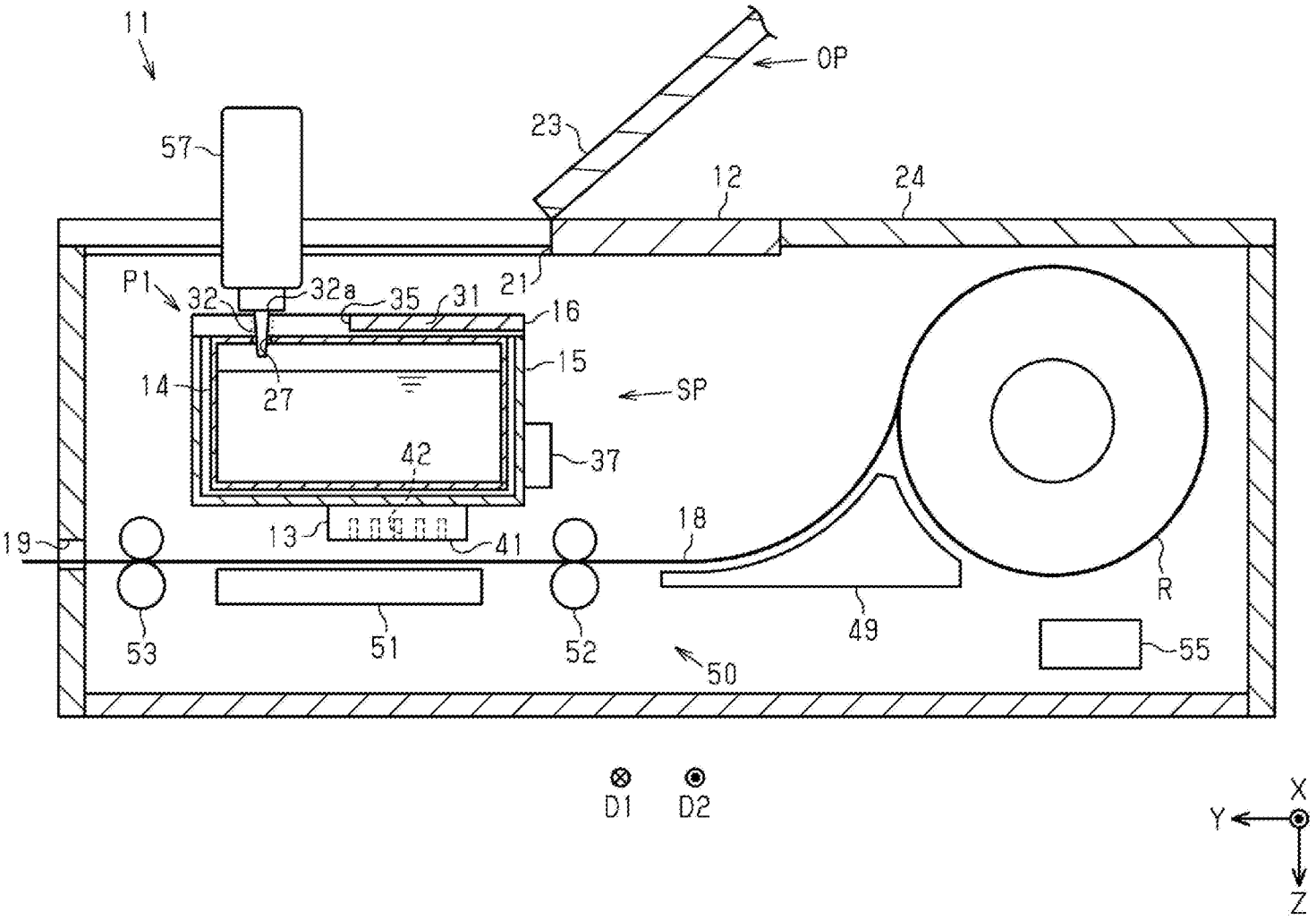
FIG. 5 is a schematic side view illustrating an internal configuration of the printer to which ink is supplied.

As illustrated in FIG. 5, when the printer cover 23 is located at the open position OP, the supply port 27 is exposed regardless of the position of the lid member 16. In other words, the plug 29 can be removed with the lid member 16 being located at the first position P1. The user can supply ink to the ink storage unit 14 by, for example, inserting a housing 57 housing ink into the supply port 27 in the state where the lid member 16 is located at the first position P1.

In attaching and/or detaching of the plug 29, inserting of the housing 57 into the supply port 27, removing of the housing 57 from the supply port 27, and the like, ink attached to the plug 29, the housing 57, and the like may scatter around the supply port 27.

The ink shattered to the upper side relative to the supply port 27 in the vertical direction falls by gravitation and adheres to the top surface of the ink storage unit 14. The ink shattered to the side of the first direction D1 relative to the supply port 27 adheres to the second portion 32. The ink shattered to the side of the second direction D2 relative to the supply port 27 adheres to the third portion 33.

Figure 6:
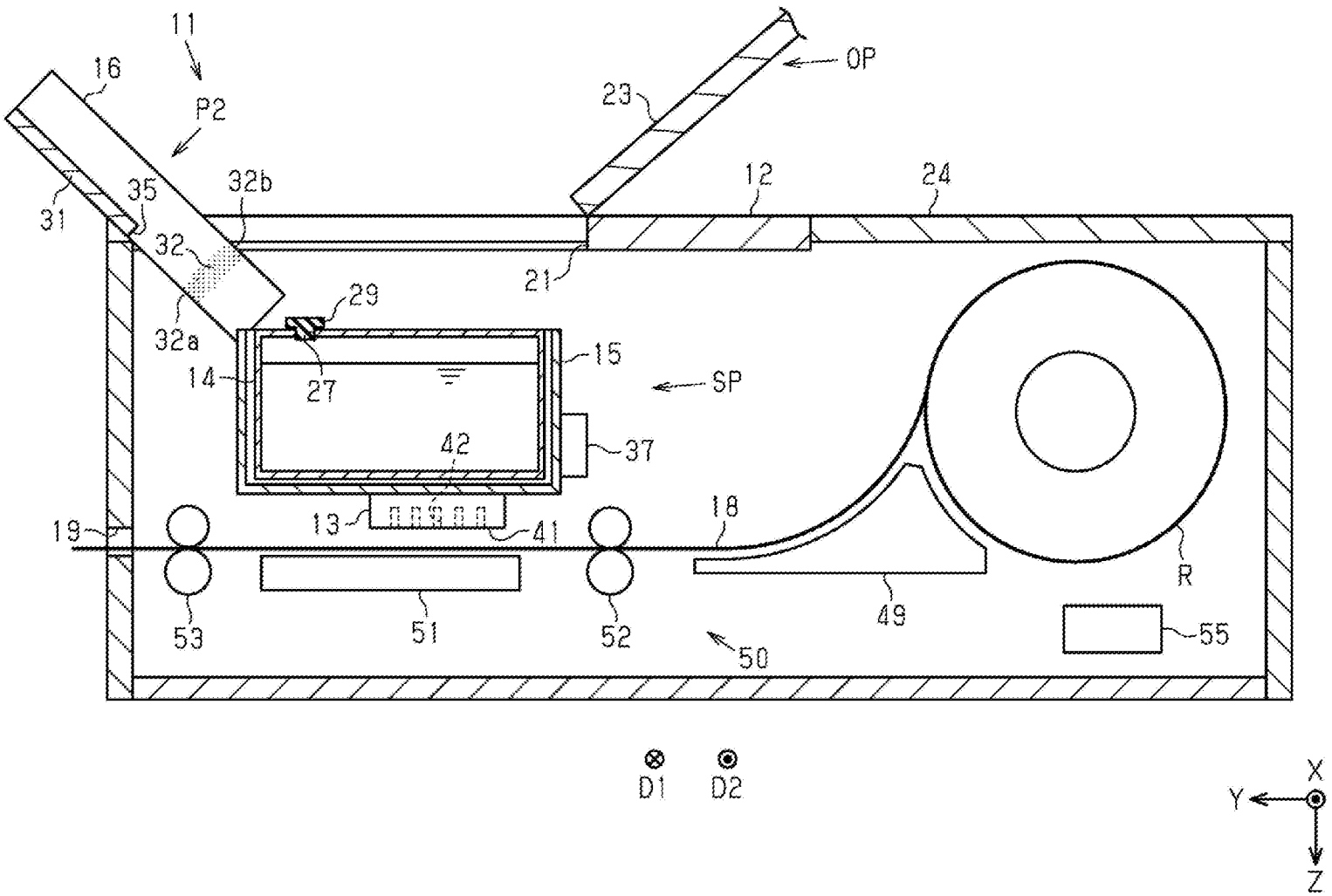
FIG. 6 is a schematic side view illustrating an internal configuration of the printer in which the lid member is located at a second position.

As illustrated in FIG. 6, to clean the scattered ink, the position of the lid member 16 is set at the second position P2. In the lid member 16 located at the second position P2, the first portion 31, the second portion 32 and the third portion 33 are located on the upper side relative to the first supply port 27*a* to the fourth supply port 27*d* in the vertical direction such that the second portion 32 and the third portion 33 face each other. Thus, the ink attached to the lid member 16 and the ink storage unit 14 can be easily cleaned.

Effects of this embodiment will now be described.

(1) The lid member 16 is rotatable to the first position P1 for limiting the removal of the ink storage unit 14 from the carriage 15 and the second position P2 for allowing the detach of the ink storage unit 14 from the carriage 15. In the lid member 16 located at the first position P1, the first portion 31 is located on the upper side of the ink storage unit 14 in the vertical direction, and the lower end 32*b* of the second portion 32 is located on the lower side relative to the supply port 27 in the vertical direction. Thus, the lid member 16 covers the supply port 27 when viewed in the horizontal direction and easily receives the scattered ink. In the lid member 16 located at the second position P2, the first portion 31 and the second portion 32 are located on the upper side relative to the supply port 27, and thus the ink attached to the lid member 16 can be easily cleaned. Thus, the scattered ink can be easily cleaned.

(2) The printer cover 23 that covers the opening 21 is provided in the case 12. Thus, the supply port 27 is covered by the printer cover 23 located at the cover position CP even when the supply port 27 is exposed regardless of the position of the lid member 16, and thus the risk of adhesion of foreign matters to the supply port 27 and the risk of entry of foreign matter into the ink storage unit 14 through the supply port 27 can be reduced.

(3) When the carriage 15 is located at the ink supply position SP, the second portion 32 of the lid member 16 is located between the transport region TA and the supply port 27. Thus, the risk of contamination of the transport region TA with the ink shattered at the supply port 27 can be reduced.

(4) The first supply port 27*a* and the second supply port 27*b* are sandwiched between the second portion 32 and the third portion 33 of the lid member 16 located at the first position P1. Thus, the ink shattered in the first direction D1 from the first supply port 27*a* or the second supply port 27*b* can be received at the second portion 32, and the ink shattered in the second direction D2 opposite to the first direction D1 can be received at the third portion 33.

(5) The carriage 15 includes the ink passage 47. Thus, for example, even when the first ink supplied to the first ink storage unit 14*a* leaks, the first ink can be ejected to the outside of the carriage 15 through the ink passage 47, and the risk of entry of the first ink into the second ink storage unit 14*b* can be reduced. In other words, even in the case where the plurality of ink storage units 14 stores different types of inks, the risk of mixing of the different types of inks can be reduced.

This embodiment may be modified as follows. This embodiment and the modified examples thereof described below may be combined insofar as they are not technically inconsistent.

The printer 11 may be a monochrome printer that performs printing by discharging ink of one type, in which one ink storage unit 14 is mounted in the carriage 15. The printer 11 may be a printer that performs two-color printing by discharging inks of two types, in which two storage units 14 are mounts in the carriage 15. Specifically, the carriage 15 may include the first ink storage unit 14*a* that includes the first supply port 27*a* and stores the first ink, and the second ink storage unit 14*b* that includes the second supply port 27*b* and stores the second ink. The number of storage units 14 mounted in the carriage 15 may be three or five or more.

The position of the ink passage 47 is not limited to the bottom wall of the carriage 15, and may be provided in the side wall of the carriage 15. When the ink passage 47 is provided at a position on the lower side relative to the supply port 27 in the vertical direction, ink that leaks from the supply port 27 and moves to the lower side in the vertical direction can be ejected to the outside of the carriage 15.

The printer 11 may include an absorber provided in the carriage 15. The absorber may be provided so as to correspond to each of the plurality of ink storage units 14. The leaked ink may be absorbed by the absorber. The absorber may be partially disposed outside the carriage 15 so as to configure an ink passage that ejects the ink to the outside of the carriage 15 by the absorber.

When the carriage 15 is located at the ink supply position SP, the ink passage 47 may be located on the upper side of the cap 39 in the vertical direction. The cap 39 may receive ink ejected out of the carriage 15 through the ink passage 47.

In the lid member 16 located at the first position P1, the second portion 32 may be located between the first supply port 27*a* and the side wall of the carriage 15 in the first direction D1. In the lid member 16 located at the first position P1, the third portion 33 may be located between the fourth supply port 27*d* and the side wall of the carriage 15 in the first direction D1.

In the lid member 16 located at the first position P1, the second portion 32 may be located on the side of the second direction D2 relative to at least one supply port 27 of the first supply port 27*a* to the fourth supply port 27*d*. For example, the second portion 32 may be located at any of a position between the first supply port 27*a* and the second supply port 27*b*, a position between the second supply port 27*b* and the third supply port 27*c*, and a position between the third supply port 27*c* and the fourth supply port 27*d*. The third portion 33 located on the side of the second direction D2 relative to the fourth supply port 27*d* may function as the second portion.

The second portion 32 may be provided on the front side or the rear side of the supply port 27.

The supply of ink to the ink storage unit 14 may be performed at the home position HP. When ink is supplied from the supply port 27 to the ink storage unit 14, the control unit 55 may put the carriage 15 on standby at the home position HP.

Hereinafter, technical concepts and effects thereof that are understood from the above-described embodiments and modified examples will be described.

(A) A printer includes a carriage in which a discharging head configured to discharge ink and an ink storage unit configured to store the ink to be supplied to the discharging head are mounted, the carriage being configured to move along a guide shaft, and a lid member provided to the carriage. The ink storage unit is detachable from the carriage, and the lid member is rotatable to a first position and a second position. When the lid member is located at the first position, a supply port included in the ink storage unit is exposed, a first portion of the lid member is located above the ink storage unit in a vertical direction so as to limit removal of the ink storage unit from the carriage, and a lower end of a second portion of the lid member is located below the supply port in the vertical direction. And when the lid member is located at the second position, the ink storage unit is removable from the carriage, and the first portion and the second portion are located above the supply port in the vertical direction.

With this configuration, the lid member is rotatable to the first position for limiting the removal of the ink storage unit from the carriage and the second position where the user can remove the ink storage unit from the carriage. In the lid member located at the first position, the first portion is located above the ink storage unit in the vertical direction, and the lower end of the second portion is located below the supply port in the vertical direction. Thus, the lid member covers the supply port when viewed in the horizontal direction and easily receive the scattered ink. In the lid member located at the second position, the first portion and the second portion are located above the supply port in the vertical direction, and thus the ink adhered to the lid member can be easily cleaned by the user. Thus, the scattered ink can be easily cleaned.

(B) The printer may further include a control unit configured to move the carriage to an ink supply position when the ink is supplied from the supply port to the ink storage unit, a case including an opening located above, in the vertical direction, the carriage located at the ink supply position, and a printer cover provided in the case, the printer cover being movable to a cover position where the printer cover covers the opening, and to an open position different from the cover position. The supply port may be exposed regardless of a position of the lid member when the printer cover is located at the open position.

In this configuration, the printer cover that covers the opening is provided in the case. Thus, the supply port is covered by the printer cover located at the cover position, even when the supply port configured to be exposed regardless of the position of the lid member, the risk of adhesion of foreign matters to the supply port and the risk of entry of foreign matters into the ink storage unit through the supply port can be reduced.

(C) The printer may further include a transport unit configured to transport a medium to which the ink is discharged. When the carriage is located at the ink supply position, and the lid member is located at the first position, the second portion may be located between a transport region and the supply port in a direction in which the carriage moves, the transport region being a region where the medium is transported by the transport unit.

In this configuration, the second portion of the lid member is located between the transport region and the supply port when the carriage is located at the ink supply position. Thus, the risk of contamination of the transport region with the ink shattered at the supply port can be reduced.

(D) In the printer, the ink storage unit may be a first ink storage unit including a first supply port as the supply port, the first ink storage unit and a second ink storage unit including a second supply port may be mounted in the carriage, and the carriage may move in a first direction and a second direction that is opposite to the first direction, and when the lid member is located at the first position, the lower end of the second portion located further in the first direction than the first ink storage unit and the second ink storage unit may be located below the first supply port and the second supply port in the vertical direction, and a lower end of a third portion located further in the second direction relative to the first ink storage unit and the second ink storage unit may be located below the first supply port and the second supply port in the vertical direction.

In this configuration, the first supply port and the second supply port are sandwiched between the second portion and the third portion of the lid member located at the first position. Thus, the ink shattered in the first direction from the first supply port or the second supply port can be received at the second portion, and the ink scattered in the second direction opposite to the first direction can be received at the third portion.

(E) In the printer, the first ink storage unit may store a first ink that is the ink, the second ink storage unit may store a second ink, and the carriage may include an ink passage configured to eject, to outside of the carriage, the first ink leaked from the first ink storage unit or the second ink leaked from the second ink storage unit.

In this configuration, the carriage includes the ink passage. Thus, for example, even when the first ink supplied to the first ink storage unit leaks, the first ink can be ejected to the outside of the carriage through the ink passage, and the risk of entry of the first ink into the second ink storage unit can be reduced. In other words, even in the case where the plurality of ink storage units store different types of inks, the risk of mixing of the different types of inks can be reduced.

(F) In the printer, the ink storage unit may be a first ink storage unit configured to store a first ink as the ink, and the first ink storage unit and a second ink storage unit configured to store a second ink may be mounted in the carriage, the carriage may move in a first direction and a second direction that is opposite to the first direction, and the carriage may include an ink passage configured to eject, to outside of the carriage, the first ink leaked from the first ink storage unit or the second ink leaked from the second ink storage unit.

With this configuration, the same effect as that of the above-mentioned printer can be achieved.

What is claimed is:

1. A printer comprising:

a carriage in which a discharging head configured to discharge ink and an ink storage unit configured to store the ink to be supplied to the discharging head are mounted, the carriage being configured to move along a guide shaft; and a lid member provided to the carriage; wherein the ink storage unit is attachable to and detachable from the carriage;

the lid member is rotatable to a first position and a second position;

when the lid member is located at the first position, a supply port included in the ink storage unit is exposed, a first portion of the lid member is located above the ink storage unit in a vertical direction so as to limit removal of the ink storage unit from the carriage, and a lower end of a second portion of the lid member is located below the supply port in the vertical direction; and when the lid member is located at the second position, the ink storage unit is removable from the carriage, and the first portion and the second portion are located above the supply port in the vertical direction.

2. The printer according to claim 1, comprising:

a control unit configured to move the carriage to an ink supply position when the ink is supplied from the supply port to the ink storage unit;

a case including an opening located above, in the vertical direction, the carriage located at the ink supply position; and a printer cover provided in the case, the printer cover being movable to a cover position where the printer cover covers the opening, and to an open position different from the cover position; wherein the supply port is exposed regardless of a position of the lid member when the printer cover is located at the open position.

3. The printer according to claim 2, comprising a transport unit configured to transport a medium to which the ink is discharged; wherein when the carriage is located at the ink supply position, and the lid member is located at the first position, the second portion is located between a transport region and the supply port in a direction in which the carriage moves, the transport region being a region where the medium is transported by the transport unit.

4. The printer according to claim 3, wherein the ink storage unit is a first ink storage unit including a first supply port as the supply port;

the first ink storage unit and a second ink storage unit including a second supply port are mounted in the carriage, and the carriage moves in a first direction and a second direction that is opposite to the first direction; and when the lid member is located at the first position, the lower end of the second portion located further in the first direction than the first ink storage unit and the second ink storage unit is located below the first supply port and the second supply port in the vertical direction, and a lower end of a third portion located further in the second direction than the first ink storage unit and the second ink storage unit is located below the first supply port and the second supply port in the vertical direction.

* * * * *